US007796868B2

(12) United States Patent
Kaastra

(10) Patent No.: US 7,796,868 B2
(45) Date of Patent: Sep. 14, 2010

(54) DEVICE AND METHOD FOR HEATING LIQUIDS, AND BASE STRUCTURE

(75) Inventor: Simon Kaastra, Dinxperlo (NL)

(73) Assignee: Ferro Techniek Holding B.V., Gaanderen (NL)

( * ) Notice: Subject to any disclaimer, the term of this patent is extended or adjusted under 35 U.S.C. 154(b) by 400 days.

(21) Appl. No.: 10/590,085

(22) PCT Filed: Feb. 25, 2005

(86) PCT No.: PCT/NL2005/000141

§ 371 (c)(1),
(2), (4) Date: Jun. 11, 2007

(87) PCT Pub. No.: WO2005/080885

PCT Pub. Date: Sep. 1, 2005

(65) Prior Publication Data

US 2008/0037968 A1 Feb. 14, 2008

(30) Foreign Application Priority Data

Feb. 25, 2004 (NL) ..... 1025564
Aug. 19, 2004 (NL) ..... 1026873

(51) Int. Cl.
*F24H 1/10* (2006.01)

(52) U.S. Cl. ..... 392/465; 392/481; 392/484

(58) Field of Classification Search ..... None
See application file for complete search history.

(56) References Cited

U.S. PATENT DOCUMENTS

| | | | | |
|---|---|---|---|---|
| 941,215 | A | 11/1909 | Wade | |
| 1,523,156 | A * | 1/1925 | Adams | 392/479 |
| 4,177,375 | A * | 12/1979 | Meixner | 219/441 |
| 4,508,957 | A | 4/1985 | Rocchitelli | |
| 5,557,704 | A | 9/1996 | Dennis et al. | |
| 6,816,670 | B1 * | 11/2004 | Renau | 392/467 |

FOREIGN PATENT DOCUMENTS

| | | |
|---|---|---|
| EP | 0672401 | 9/1995 |

* cited by examiner

*Primary Examiner*—Thor S Campbell
(74) *Attorney, Agent, or Firm*—The Webb Law Firm

(57) ABSTRACT

Devices for heating liquids have been known for a long time. The applications of these devices can also be of very diverse nature. Such heating devices are thus for instance already applied on a large scale as, or applied as component in, water kettles, dishwashers, washing machines, coffee-making machines, shower water heaters and the like. The invention relates to a device for heating liquids. The invention also relates to a base structure for use in such a device. The invention further relates to a method for heating liquids.

13 Claims, 8 Drawing Sheets

H-H

DEVICE AND METHOD FOR HEATING LIQUIDS, AND BASE STRUCTURE

BACKGROUND OF THE INVENTION

1) Field of the Invention

The invention relates to a device for heating liquids. The invention also relates to a base structure for use in such a device. The invention further relates to a method for heating liquids.

2) Description of the Related Art

The device stated in the preamble has already been known for a long time. The applications of this device can also be of very diverse nature. Such heating devices are thus for instance already applied on a large scale as, or applied as component in, water kettles, dishwashers, washing machines, coffee-making machines, shower water heaters and the like. In for instance coffee-makers the device is adapted in particular for instant supply of heated water. For this purpose such a device is usually provided with a tubular body adapted for through-flow of a liquid for heating. During flow through the tubular body the liquid is heated by a heating element positioned on the tubular body or, conversely, close to the tubular body. Such a method of heating liquids has a number of drawbacks. A significant drawback of the known device is that heating of the liquid takes place with relative difficulty, among other reasons because of the relatively disadvantageous (low) surface to volume ratio. The tube length will therefore generally have to be relatively great to enable a desired heating result to be realized. Application of a relatively long tubular body generally results in a relatively long length of stay of the liquid in the device, required to allow the liquid to be heated sufficiently and as desired. It will therefore usually take a relatively long time before the heated water can be available to a user. The heating of the liquid will furthermore take place with relative difficulty due to the relatively inefficient heat transfer from the heating element, via the tubular body, to the liquid for heating, which also has an (adverse) effect on the relatively slow heating of the liquid. In addition, the cost of manufacturing the known device and for the use of the device (because of the relatively inefficient heating) is relatively high.

SUMMARY OF THE INVENTION

The invention has for its object to provide an improved device for heating liquids, with which a liquid can be heated in relatively efficient and rapid manner.

The invention provides for this purpose a device comprising a base structure and at least one heating element connected to the base structure, wherein at least one non-linear channel structure is arranged between the base structure and the heating element for throughflow of a liquid for heating, wherein the device comprises bias-generating means to enable the base structure to connect under bias to the heating element. Application of the bias-generating means will press the base structure under bias against the heating element, whereby the formation of gaps between the heating element and the base structure can thus be prevented, as a result of which permanent connection of the strip to the heating element is enabled and de facto compensation for deformation of the heating element is allowed. The bias can herein be realized by bias-generating means, such as for instance a diaphragm spring. A diaphragm spring is particularly advantageous here in enabling a homogeneously distributed bias to be realized. The channel structure is in fact bounded and formed here by both the base structure and the heating element. Heat can thus be transferred directly—without interposing another element—and therefore relatively efficiently from the heating element to the liquid for heating. Particularly in the case where liquid is driven through the channel structure at relatively high speed, a relatively efficient and rapid heat transfer per unit of volume of liquid can be achieved per unit of time. An additional advantage here is that precipitate, such as for instance limescale, cannot be deposited in the channel structure, or at least hardly so, as a result of the relatively high flow speed, which results in a relatively low-maintenance device. Because the channel structure does not take a linear form, the contact surface between the heating element and the liquid for heating situated in the channel structure can be maximized, which, in addition to a relatively rapid heating of the liquid to a desired temperature, also results in a relatively compact device for rapid and efficient heating of liquids. Furthermore, application of the device according to the invention functioning in energetically advantageous manner generally results in a cost saving. By applying the channel structure arranged between the base structure and the heating element, the surface area to volume ratio of the channel structure can moreover be maximized in relatively simple manner by for instance giving the channel or the channels of the channel structure a relatively flow (shallow) form, whereby the channel structure only acquires a limited volume, which can considerably improve the temperature increase of the liquid for heating per unit of time. The throughput time of the liquid through the device can be reduced considerably by the significantly improved heating of the liquid per unit of time, whereby the user can dispose of the heated liquid relatively quickly. The liquid can herein be guided through the channel structure at a flow rate of up to several meters per second, preferably between 1 and 3 meters per second. Such a relatively high flow rate is particularly advantageous in that vapour bubbles which may form in the channel structure are generally flushed immediately out of the device. Such a relatively high flow rate furthermore prevents deposition of contaminants, such as lime and the like, on the heating element and/or the base structure. The deposition of contaminants on the heating element is particularly adverse for the heat transfer from the heating element to the liquid for heating. It is noted that the non-linear channel structure is provided with one or more, optionally mutually parallel, non-linear channels, wherein the liquid for heating runs through a non-linear two-dimensional or three-dimensional route. It is however very well possible here to envisage parts of channel structure nevertheless taking a linear form, but wherein the liquid runs through the device via a labyrinthine route.

In a preferred embodiment, at least a part of the channel structure is arranged recessed into an outer surface of the base structure. The channel structure can already be arranged in the base structure beforehand during manufacture of the base structure, but can also be arranged in the base structure at a later stage. The base structure is generally formed here by a plastic and/or metal carrier layer, in which one or more non-linear channels are arranged. The channel structure can be arranged as cavity in the base structure. In another preferred embodiment, at least a part of the channel structure is arranged recessed into the heating element. Such a preferred embodiment is advantageous in that the contact surface between the heating element and the liquid for heating can thus be increased, which will generally result in a more intensive and more rapid heating. It is also possible to envisage arranging the channel structure in the base structure as cavity pattern, wherein the heating element is provided with a counter-cavity pattern connecting onto the cavity pattern.

The heating element preferably has a substantially plate-like form. Plate-like heating elements are already known commercially and are generally relatively cheap to manufacture. From a structural viewpoint it is moreover usually advantageous to apply a flat heating element. The heating element is then generally formed by an electric heating element which is preferably provided on a side remote from the channel structure with a track-like thick film for forced conduction of electric current so as to enable generation of a desired heat.

In another preferred embodiment, the channel length of the channel structure lies between 0.3 and 7 meters, in particular between 0.5 and 5 meters, and is more preferably substantially 2 meters. Such a length is generally sufficient to heat liquid such as water, oil, etc. from room temperature to a temperature of more than 90 degrees Celsius. Since the channel structure has a non-linear form, the volume taken up by the channel structure will be relatively limited, which enhances handling of the device according to the invention.

In yet another preferred embodiment, the cross-section of the channel structure has a surface area which lies between 1 and 100 $mm^2$, in particular between 2 and 50 $mm^2$. The exact area generally depends on the specific application of the device. A device for heating water for making tea or coffee thus preferably has a cross-section of between 2 and 5 $mm^2$. For heating water which can then be drawn via a tap, usually a shower tap or bath tap, a channel structure with a cross-section of between 10 and 60 $mm^2$ is preferably applied. The same cross-section can for instance also be applied for heating frying oil.

The non-linear channel structure preferably has an at least partly angular form. By arranging one or more angles in the channel structure a two-dimensional or optionally three-dimensional flow progression of the liquid for heating can be realized. The liquid can thus be guided relatively efficiently along the (relatively compact) heating element to thus be heated to a required temperature. In another preferred embodiment, the channel structure has an at least partly curved form. Liquid can for instance also be heated to a required temperature in relatively compact and intensive manner by giving the channel structure a substantially spiral form. The base structure preferably takes an at least partly flexible form, wherein in particular a side of the base structure directed toward the heating element preferably takes a flexible, in particular elastic, form. For this purpose the base structure is preferably at least partly manufactured from an elastic material, in particular an elastomer. In an alternative preferred embodiment, the base structure comprises a composite strip of a metal band and a thermally insulating layer connected to the metal band, wherein the strip in spirally wound state does in fact form the channel structure. For this purpose the height of the metal band is preferably greater than the height of the insulating layer. The insulating layer is preferably formed by vulcanized rubber in order to also enable generation of a medium-tight sealing of the channel structure in addition to a thermal insulation. The thermally insulating layer is preferably manufactured from an elastomer. The thermally conductive metal band can for instance be formed from strip steel. A channel structure with a cross-section of 2×2 millimeters can for instance be formed by rolling up a composite strip of strip steel with a height of 6 millimeters and a thickness of about 0.6 millimeters, which has adhered thereto vulcanized rubber material with a height of 4 millimeters and a thickness of 2 millimeters. In an alternative embodiment, the composite strip can also be an integrated construction of a relatively high strip part and an adjacent relatively low strip part.

Although the metal strip is generally relatively rigid, the wound composite strip nevertheless has a certain flexibility in that mutually adjoining strip parts of the strip can slide relative to each other. Such a flexible character is particularly advantageous in making it possible to compensate (considerable) deformations of the heating element and height differences resulting therefrom during heating of the heating element, wherein the strip can connect to the heating element in reliable and medium-tight manner irrespective of the degree of deformation of the heating element, whereby leakage from the device of liquid and evaporation gases originating therefrom can be prevented. In order to enable permanent connection of the strip to the heating element and to allow for de facto compensation for deformation of the heating element, the base structure, in particular the strip, is pressed under bias against the heating element, whereby the formation of gaps between the heating element and the base structure can thus be prevented. The bias can herein be realized by bias-generating means, such as for instance a diaphragm spring. A diaphragm spring is particularly advantageous here in enabling a homogeneously distributed bias to be realized.

In yet another preferred embodiment, the base structure is formed by a plurality of separate, mutually connected base modules. The base modules can herein be of very diverse nature and can for instance be formed by partitions held at a mutual distance by spacers, wherein the relative orientation of the base modules determines the channel structure.

The device is preferably provided with a pump for pumping the liquid for heating under pressure through the channel structure. Because liquid can be heated relatively rapidly, intensively and efficiently using the device according to the invention, the liquid flow rate through the channel structure can be increased, on the one hand to prevent too intensive a heating of the liquid and on the other to increase the capacity of the device. The pump flow rate of the pump, i.e. the number of units of volume of liquid per unit of time, can preferably be regulated. It can be advantageous to regulate the pump flow rate so as to be able to satisfy the user need in relatively simple manner. If a large quantity of liquid is for instance required, the pump flow rate can be increased (temporarily) to enable the requirement of the user to be met relatively quickly. In a particular preferred embodiment, the device is provided with sensor means coupled to the pump to enable regulation of the pump flow rate subject to the liquid temperature in the channel structure. The sensor means are herein preferably positioned before the device in order to measure the temperature of the relatively cold liquid. Together with a desired end temperature of the liquid and the heat-transferring capacity of the heating element, the most ideal pump flow rate can thus be calculated and applied without delay occurring in the heating system, this latter in contrast to the situation in which the sensor means are positioned after the device and are adapted for detect the temperature of the heated liquid. By adjusting the pump flow rate it is for instance possible to prevent the liquid becoming overheated in the channel structure. When one or more critical temperatures are exceeded, the pump flow rate can be increased to prevent overheating. In the case that the liquid temperature in the channel structure is relatively low—if the heating element has for instance just been switched on—the pump flow rate can be (temporarily) reduced in order to increase to some extent the length of stay of the liquid in the channel structure, whereby an improved heating of the liquid can be achieved.

In a preferred embodiment, the heating element is displaceable relative to the base structure (and vice versa) between a (closed) position connecting to the channel structure and an (opened) position situated at least partially at a distance from the channel structure. The usual position will generally be formed by the position in which the heating element connects to the base structure, and thus in fact bounds the channel structure. The liquid for heating is then guided along the heating element via the channel structure and thus heated. Evaporation of the liquid in the channel structure can be prevented or at least be countered, by guiding the liquid under (some) pressure through the channel structure. In the opened position, in which the heating element lies at least partially at a distance from the channel structure (and thereby the base structure), the liquid guided in the device will no longer be guided only via the channel structure but, as a result of evaporation, will spread in a bounded evaporation chamber or steam chamber—which is relatively voluminous relative to the volume of the channel structure—formed by the heating element and the base structure, whereby vapour, usually steam, will form. It is therefore possible to generate a heated liquid as well as steam by means of a single heating element. The change in the relative orientation between the heating element and the base structure preferably takes place electromechanically, pneumatically, hydraulically or manually. In order to enable the change in orientation between the heating element and the base structure, the heating element can take a form which is pivotable or integrally displaceable in optionally vertical manner relative to the base structure. It is noted that the opened position can also be advantageous in the case of maintenance operations, due to the improved accessibility of both the heating element and the base structure, including the channel structure. In a particular preferred embodiment, the pump is coupled to the heating element and/or the base structure in order to change the relative orientation of the heating element and the base structure. In addition to supplying liquid under pressure to the base structure, the pump is thus also adapted to displace the heating element and the base structure relative to each other as required.

The invention also relates to a base structure for use in such a device.

The invention further relates to a method for heating liquids using such a device, comprising the steps of: a) activating the heating element, and b) guiding a liquid for heating through a passage formed between the heating element and the base structure. The passage will usually be formed by the channel structure. However, as already described in the foregoing, it is also possible to place the heating element at least partially at a distance from the channel structure, whereby the volume of the passage through which flow takes place can be increased and vapour formation (steam formation) is thus made possible. The outlet opening for the generated voluminous steam will in that case usually be larger than the outlet opening for heated liquid so as to prevent obstructions during discharge of the generated steam from the device. While step b) is being performed the liquid for heating will however preferably be guided along the heating element in order to be able to ensure sufficient heating of the liquid. Guiding of the liquid for heating along the heating element via the channel structure as according to step b) preferably takes place under increased pressure. This increased pressure can vary from atmospheric pressure to higher pressures up to about 10 bar. Further advantages of the method according to the invention have already been described at length in the foregoing.

BRIEF DESCRIPTION OF THE DRAWINGS

The invention will be elucidated on the basis of non-limitative exemplary embodiments shown in the following figures. Herein.

DETAILED DESCRIPTION OF THE PREFERRED EMBODIMENTS

Figure 1:
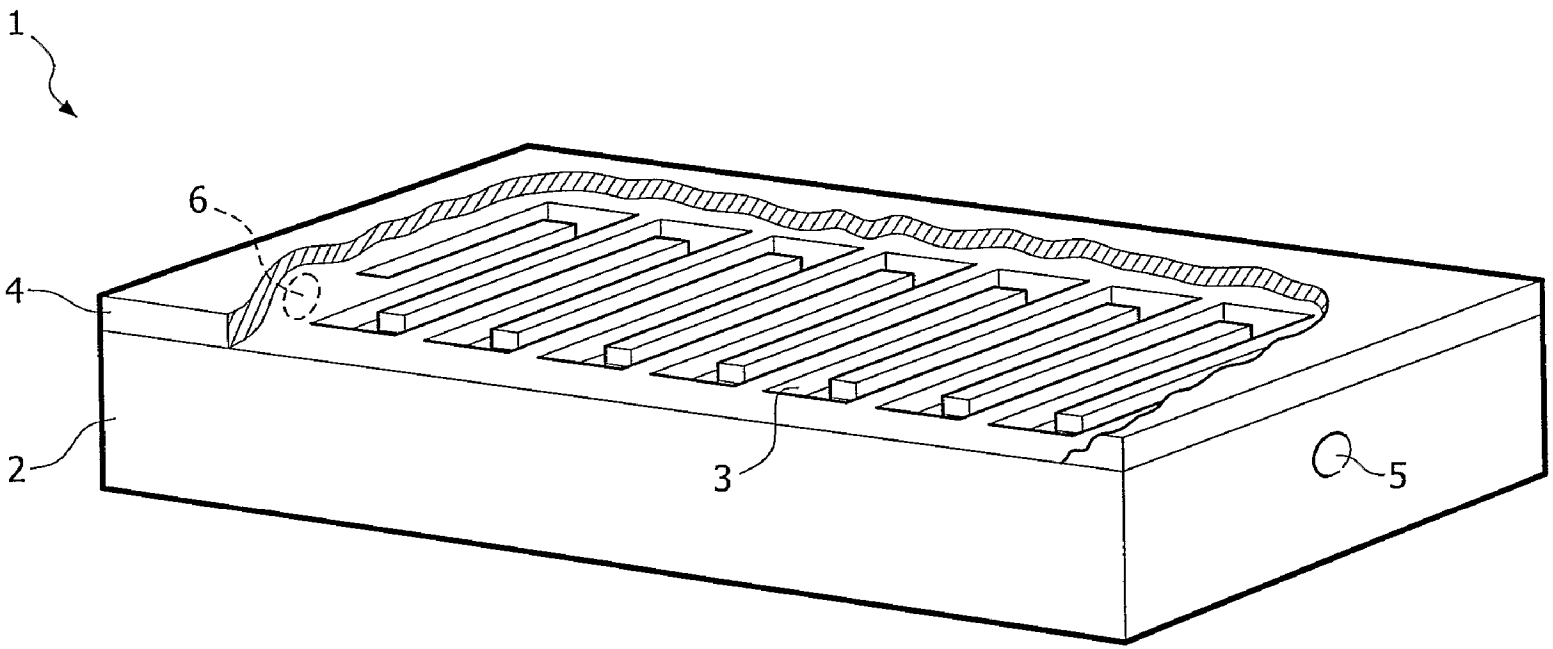
FIG. 1 shows a partly cut-away perspective view of a first embodiment of the device according to the invention.

FIG. 1 shows a partly cut-away perspective view of a device 1 according to the invention. Device 1 comprises a base structure 2 and a heating element 4 connecting thereto in substantially medium-tight manner. Heating element 4 and base structure 2 are clamped together by means of clamping means (not shown). Arranged between base structure 2 and heating element 4, and in particular in an upper surface of base structure 2, is a non-linear channel structure 3 for guiding a liquid for heating along heating element 4. The liquid for heating is pumped into channel structure 3 via a feed opening 5 and, after heating, exits channel structure 3 via an outlet opening 6. FIG. 1 shows that channel structure 3 takes a zig-zag form and is furthermore provided with a plurality of angular transitions from the one linear channel part to the adjacent linear channel part. It will be apparent that the length of the channel structure comprises a multiple of the length of the heating element due to this angular, non-linear form, whereby liquid can be heated in relatively efficient and intensive manner.

Figure 2A:
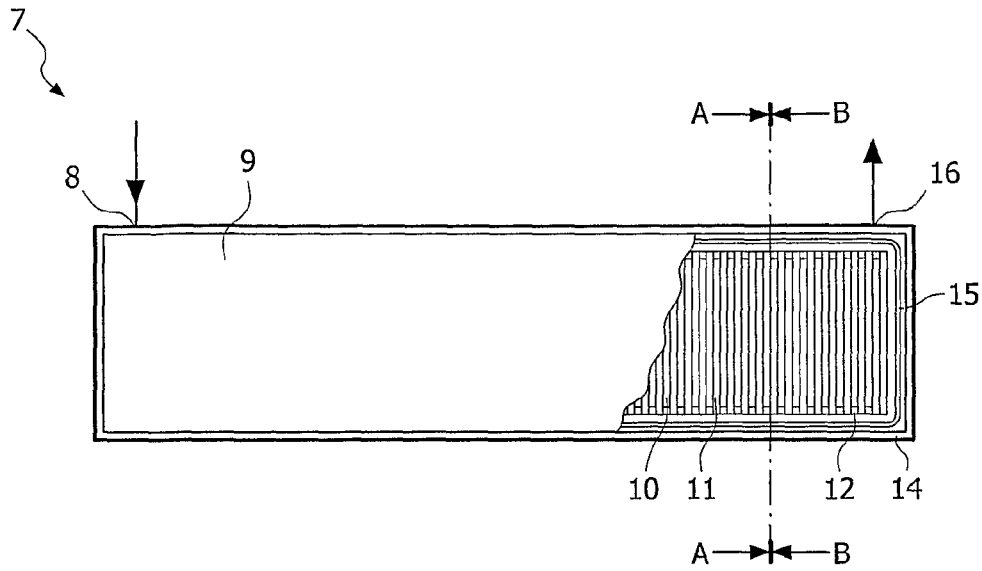
FIG. 2*a* shows a partly cut-away top view of a second embodiment of the device according to the invention.

FIG. 2*a* shows a partly cut-away top view of a second embodiment of device 7 according to the invention. Device 7 comprises a base structure 14 and a heating element 9 connecting thereto. FIG. 2*a* shows that a sealing element 15 is provided for the purpose of a medium-tight seal between heating element 9 and base structure 14. A thermo-resistant rubber O-ring can for instance be used as sealing element. Heating element 9 and base structure 14 are clamped together by means of clamping means (not shown). A plurality of guide elements 10, 11 are arranged in a recess in base structure 14 such that guide elements 10, 11 together form a flow route 12 for liquid. The liquid for heating is fed to flow route 12 via feed opening 8 and, after being heated by the heating element, is discharged via outlet opening 16.

Figure 2B:
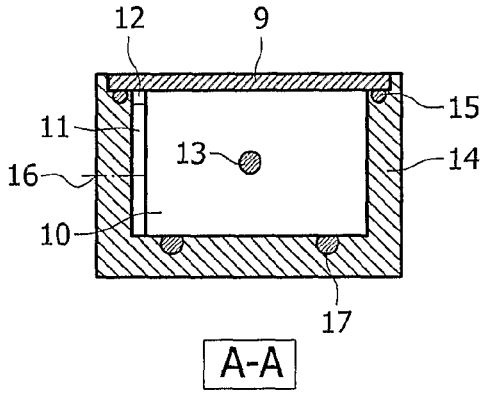
FIG. 2*b* shows a cross-section along line A-A as indicated in FIG. 2*a*.
Figure 2C:
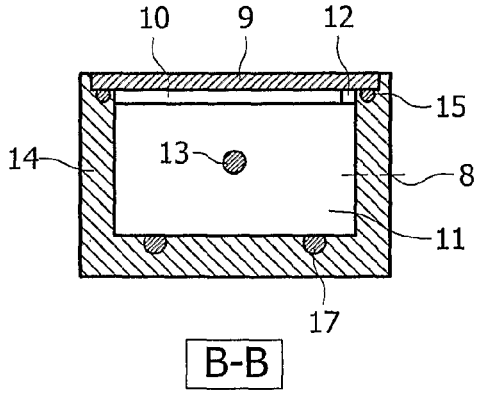
FIG. 2*c* shows a cross-section along line B-B as indicated in FIG. 2*a*.

FIGS. 2*b* and 2*c* show cross-sections along line A-A and B-B respectively, which are indicated in FIG. 2*a*. Flow route 12 is in fact formed by the different dimensions of guide elements 10 and 11 placed adjacently of each other in the recess of base structure 14. This is achieved in that the width of guide element 10 is smaller than the width of the recess in base structure 14, and in that the height of guide element 11 is smaller than the height of the recess in base structure 14. By positioning the space in the width of the guide element 10 alternately on the one and on the other side of the recess in the base structure, the spaces situated above guide element 11, on either side of guide element 10, are mutually connected. A zig-zag-shaped flow route 12 is thus obtained, wherein the liquid for heating flows substantially in a direction transversely of the longitudinal direction of heating element 9. Guide elements 10 and 11 are herein preferably connected to each other by means of a connecting element 13, which connecting element 13 can for instance be formed by a rubber cord. In order to bring about a substantially medium-tight connection of guide elements 10, 11 to heating element 9, guide elements 10, 11 are placed on elastic elements 17.

Figure 3A:
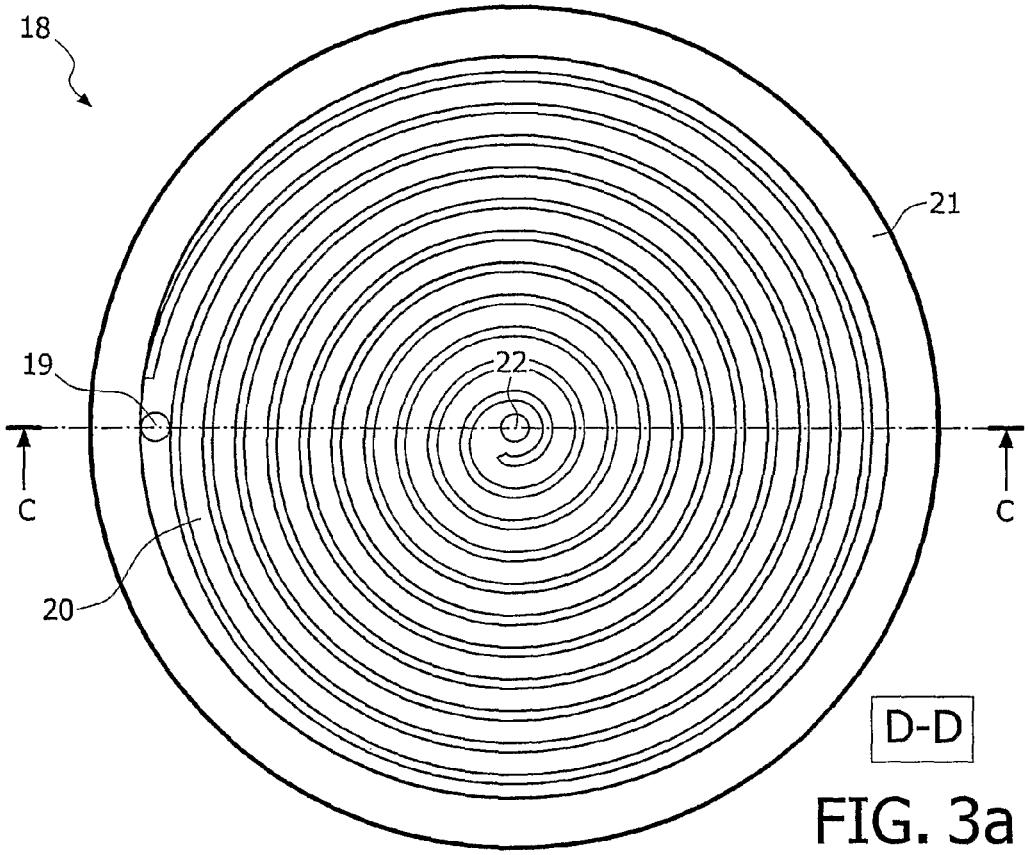
FIG. 3*a* shows a cross-section of a third embodiment of the device according to the invention.
Figure 3B:
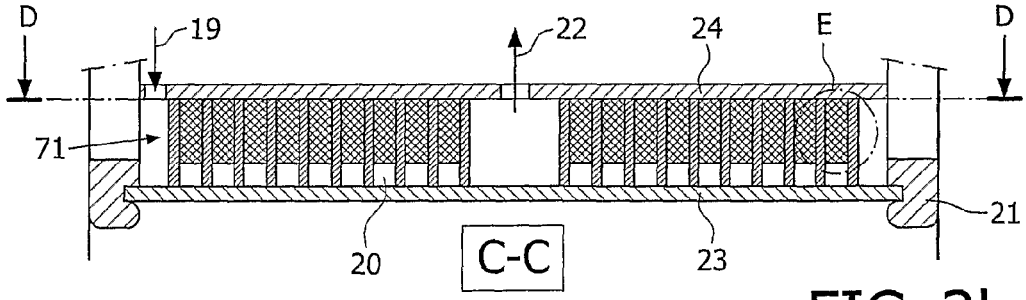
FIG. 3*b* shows a cross-section along line C-C as indicated in FIG. 3*a*.
Figure 3C:
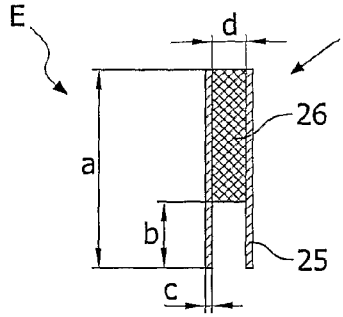
FIG. 3*c* shows a detail E as indicated in FIG. 3*b*.

FIG. 3*a* shows a cross-section of a third embodiment of a device 18 according to the invention. This cross-section represents a view along line D-D as shown in FIG. 3*b*. Device 18 comprises a base structure 71 and a heating element 23 connecting to base structure 71. Base structure 71 herein forms a spiral channel 20 for liquid for heating which is opened on one side. In the shown exemplary embodiment the channel 20 is however sealed medium-tightly by the adjacent heating element 23. In order to have base structure 71 connect to heating element 23 in stable, reliable and medium-tight manner, device 18 comprises a pressing element 24, in particular a diaphragm spring, for pressing base structure 71 under bias onto the heating element in order to enable a reliable sealing of spiral-shaped channel 20 to be realized. Base structure 71 is in fact constructed from a metal wound in a spiral shape, in particular strip steel, or plastic strip 25, and an adjacent insulating (rubber) strip 26 connected to this plate. In the wound-up situation of base structure 71 the base structure has a certain flexibility, despite the generally rigid character of band 25, since mutually adjacent parts of base structure 71 are mutually displaceable, which is particularly advantageous when heating element 23 deforms as a result of heating of heating element 23. In this manner a permanent and medium-tight sealing of channel 20 can be guaranteed, wherein deformations of device 18, in particular of heating element 23, can be compensated relatively easily and effectively. A seal (not shown) can be applied to prevent possible flow of liquid out of channel 20 and along pressing element 24. An annular seal 21 adapted to clamp heating element 23 connects heating element 23 to device 18 and holds it in position relative to channel 20 and thereby pressing element 24. As already noted, pressing element 24 is preferably manufactured from a resilient material, such as a diaphragm spring, so that base structure 71 connects fully and permanently to heating element 23 despite possible variations in the flatness of heating element 23. Such elements in any case generally have a slightly concave shape in respect of the desired compression strength thereof. Channel 20 is open on one side and is adapted to be fully covered by the plate-like heating element 23 (see FIG. 3*b*). Channel 20 is herein provided with a feed 19 and a discharge 22 for liquid, which is preferably pumped through channel 20 under a pressure above atmospheric. The cylindrical pressing element 24 is enclosed in substantially medium-tight manner by an inner wall of the device. It is however also possible here to envisage realizing the separation between relatively cold and hot liquid in other manner. FIG. 3*b* herein shows a cross-section along line C-C as indicated in FIG. 3*a*. Liquid can be carried into device 18 via feed 19 and exits the device via discharge 22 after passing through the spiral-shaped channel 20. While passing through channel 20 the liquid is heated directly, i.e. without interposing of any other element, by the plate-like heating element 23 bounding channel 20. Since the channel cross-section 20 is rather small (generally between 2 and 50 $mm^2$) the liquid volume of device 18 is likewise relatively small. Owing to the efficient and intensive heat transfer from heating element 23 to the liquid, the liquid will however be able to reach a desired temperature relatively quickly. In order to prevent overheating of the liquid and to increase the capacity of device 18, the liquid will generally be pumped through device 18 under a pressure of about 10 bar. The liquid will preferably cover a channel length here of 0.5, 1, 2, 4, 5 or 6 meters. FIG. 3*c* shows a detail E as indicated in FIG. 3*b* and clearly shows that channel 20 is formed in modular manner by a metal (steel) or plastic strip 25 wound in a spiral shape and an adjacent insulating (rubber) strip 26. Test results have shown that specific ratios between parameters a, b, c and d (see FIG. 3*c*) have an advantageous effect on the heating of the liquid. The heating of the liquid to a desired temperature can be optimized if the ratio 30:10:1:5 is applied for ratio a:b:c:d. It is particularly advantageous to minimize parameter c in order to be able to maximize the contact surface between heating element 23 and the liquid for heating. The modular construction of a base structure for forming of a spiral-shaped channel provides a high degree of flexibility in that the base structure can then be replaced relatively easily by another base structure, and therewith another channel with a different dimensioning. In the shown exemplary embodiment the band 25 and/or strip 26 will for this purpose be replaced by a plate respectively a strip with a different dimensioning. Since the flow rate of the liquid through channel 20 will usually be constant, the dimensioning, in particular the length and the cross-section, of channel 20 determines the heat transferring capacity, whereby device 18, and in particular the capacity of device 18, can be modified relatively simply to the specific application for which device 18 is being used. Heat can moreover be transferred in relatively efficient and effective manner using the device, since the thermally insulating strip 26 prevents heat loss, which stimulates the accumulation of heat in the liquid for heating.

Figure 4:
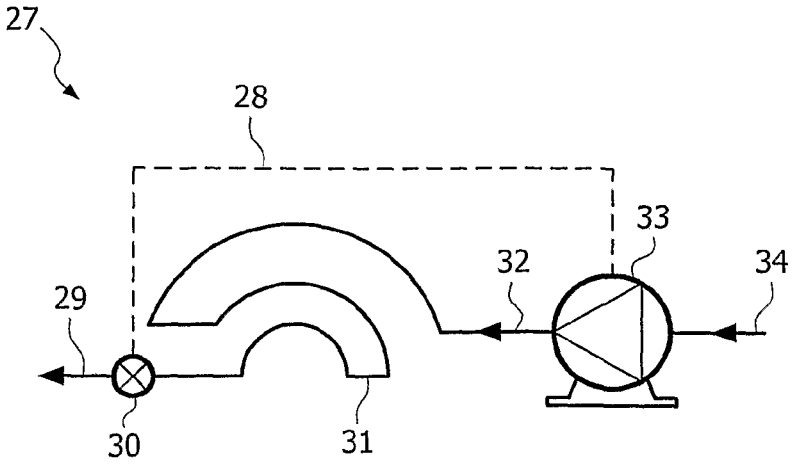
FIG. 4 is a schematic representation of another embodiment of the device according to the invention.

FIG. 4 shows a schematic representation of another embodiment of a device 27 according to the invention. Device 27 herein comprises a pump 33 and a non-linear channel structure 31 connected to pump 33. Channel structure 31 is formed here by a single channel which has a both curved and angular form. Channel structure 31 herein connects to a thick film element (not shown) for heating a liquid, such as water or oil, flowing through channel structure 31. To this end relatively cold liquid is first guided to pump 33 via a conduit 34, whereafter the relatively cold liquid is guided under pressure in the direction of channel structure 31 via another conduit 32. The liquid is heated in channel structure 31. Via an outlet conduit 29 the heated liquid can be removed from device 27 and consumed by a user or be used for other purposes. Device 27 is also provided with a temperature sensor 30 which is coupled to pump 33 via a conduit 28 and positioned in or close to outlet conduit 29 of channel structure 31. If sensor 30 detects that the liquid temperature exceeds a critical limit, sensor 30 will increase the pump flow rate of pump 33 via a regulator (not shown) coupled to the sensor such that the (over)heated liquid will be flushed relatively quickly out of device 27, whereby further overheating can be prevented. A similar (reverse) situation can occur when the liquid is heated insufficiently, whereafter the pump flow rate can be (temporarily) reduced.

Figure 5A:
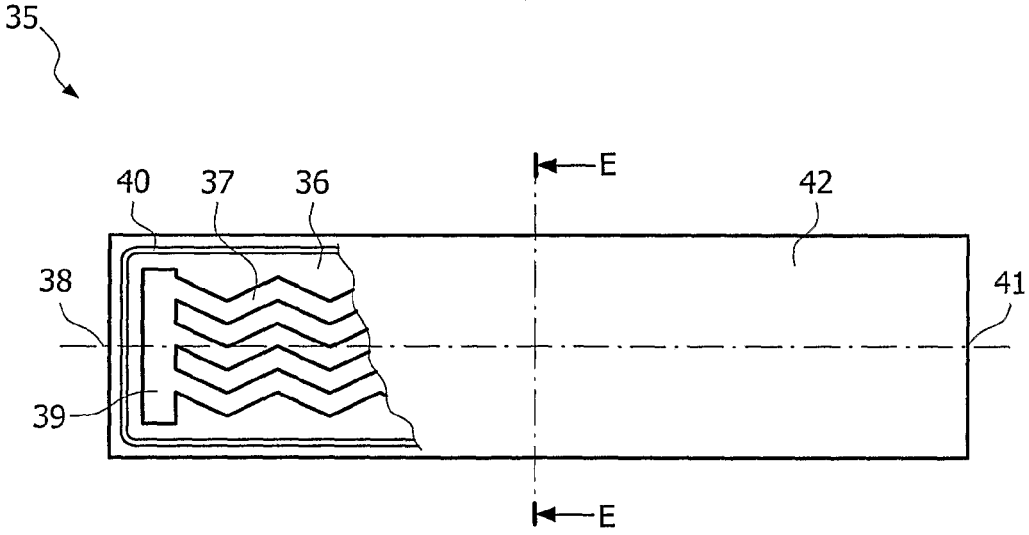
FIG. 5*a* shows a partly cut-away top view of a fifth embodiment of the device according to the invention.
Figure 5B:
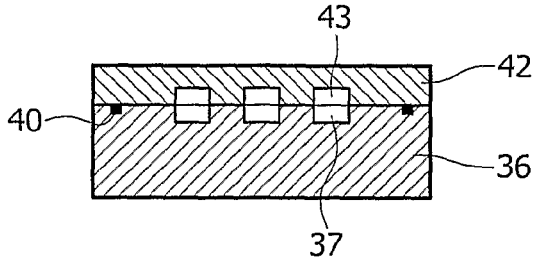
FIG. 5*b* shows a cross-section along line E-E as indicated in FIG. 5*a*.

FIG. 5*a* shows a partly cut-away top view of yet another embodiment of a device 35 according to the invention. Device 35 comprises a support structure 36, which support structure 36 is provided on the top side with a plurality of parallel oriented, non-linear channels 37, which channels are mutually coupled on either side of support structure 36 by means of a collector 39. Channels 37 are adapted for throughflow of liquid and are provided with an inlet 38 and an outlet 41 for liquid. The upper side of the non-linear channels 37 is wholly covered as channel structure by a plate-like electrical heating element 42. Arranged between support structure 36 and heating element 42 is a seal 40 to prevent, or at least counter, leakage of liquid from device 35. FIG. 5*b* shows a cross-section along line E-E as indicated in FIG. 5*a*. FIG. 5*b* shows that a side of heating element 42 directed toward support structure 36 is also provided with (three) non-linear, identical (zig-zag-shaped) channels 43. Channels 37 of support structure 36 herein connect over substantially the entire length to channels 43 of heating element 42. In this manner the channel volume of device 35 can still be increased to some extent, wherein the heat transfer capacity of device 35 is at least maintained.

Figure 6:
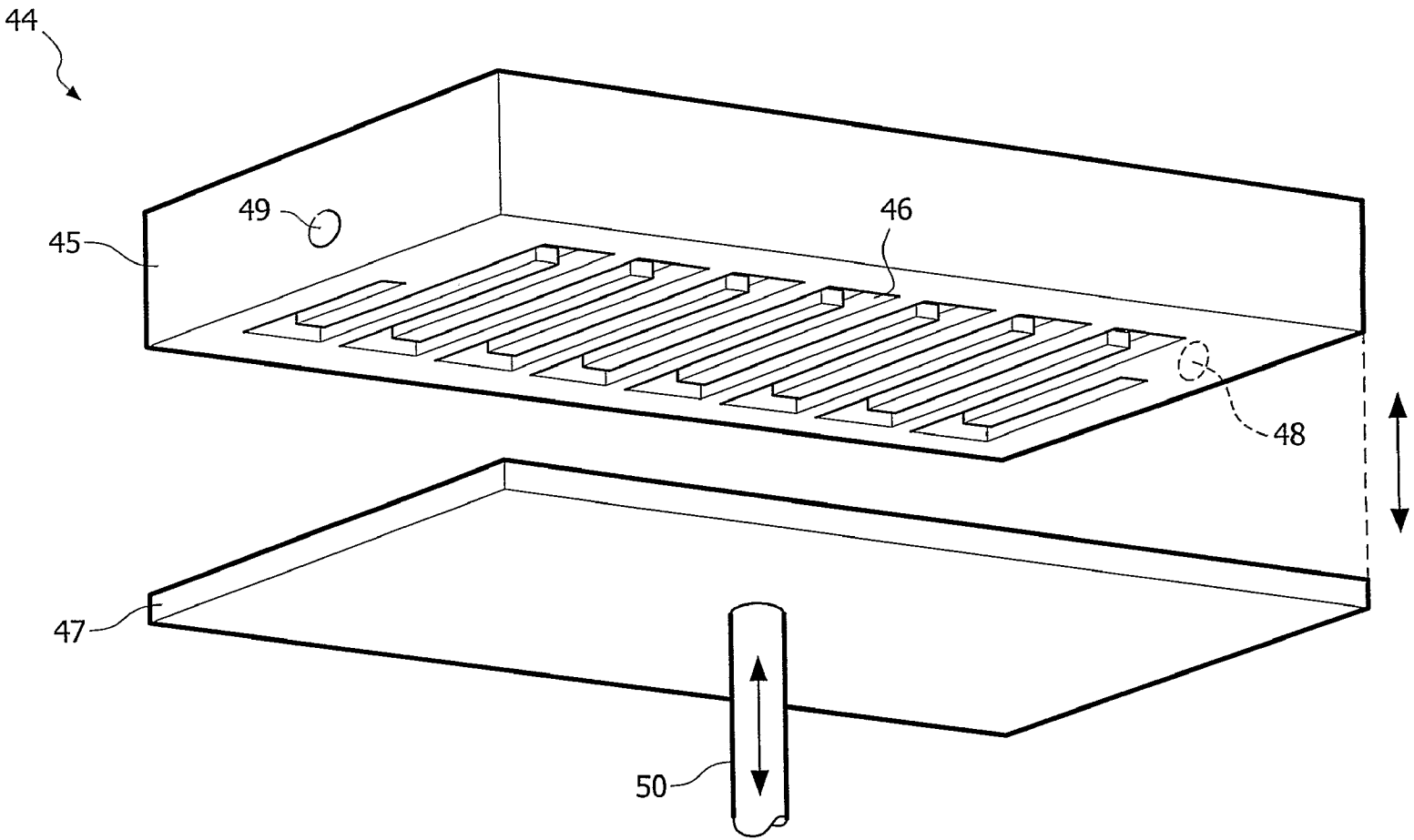
FIG. 6 is a perspective view of a sixth embodiment of the device according to the invention.

FIG. 6 shows a perspective view of a sixth embodiment of device 44 according to the invention. Device 44 comprises a base structure 45 in which there is arranged a channel structure 46 adapted in the first instance to guide a liquid for heating. Device 44 also comprises a heating element 47 adapted to heat liquid fed to device 44. The relative orientation of base structure 45 and heating element 47 can be changed, wherein heating element 47 is displaceable relative to the base structure 45, which (in this exemplary embodiment) is in a stationary disposition, by means of a displacing member 50 coupled to heating element 47. FIG. 6 shows device 44 in an opened position, wherein the heating element does not connect directly onto channel structure 46. A liquid fed to channel structure 46 via a feed opening 49 arranged in base structure 45 will in this case evaporate out of channel structure 46 in the direction of a space formed between base structure 45 and heating element 47, while forming steam. Via an outlet opening 48 formed in base structure 45 the formed steam can then be discharged and usefully employed. In the case that the heating element is placed against base structure 45, wherein heating element 47 in fact bounds channel structure 46 on one side, the liquid fed under some pressure to channel structure 46 will only be heated and further discharged from device 44 via outlet opening 48, whereafter use can be made of the heated liquid. Using device 44 according to FIG. 6 liquid can thus be heated or steam can be generated using a single heating element 47. Device 44 can be applied particularly advantageously in a coffee-making machine (or other device for preparing drinks), whereby espresso coffee and the like can also be prepared using steam. Due to the relatively efficiently constructed, relatively compact device 44 according to the invention, the coffee-making machine can herein likewise be given a relatively compact form.

Figure 7A:
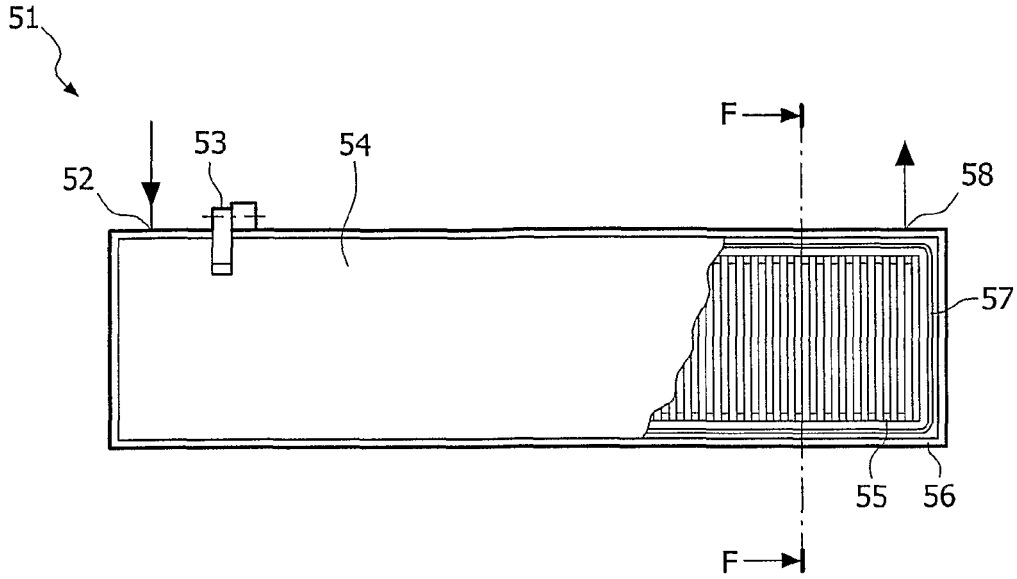
FIG. 7*a* is a partly cut-away top view of a seventh embodiment of the device according to the invention.

FIG. 7*a* shows a partly cut-away top view of a seventh embodiment of device 51 according to the invention. Device 51 comprises a base structure 56 provided with a flow route 55, and a heating element 54 connected hingedly to base structure 56 via a hinge element 53. Liquid can be fed to flow route 55 via a feed opening 52. In the case that heating element 54 connects to base structure 56 via a sealing element 57, the liquid supplied to device 51 will be heated in flow route 55 by heating element 54, whereafter the heated liquid will be removed from device 51 via outlet opening 58 and can thus be employed for determined purposes. In the case that heating element 54 is pivoted in a direction away from base structure 56, the flow route 55 will be left clear for a substantial part, thereby making possible evaporation of liquid fed to device 51, and thus formation of steam in device 51.

Figure 7B:
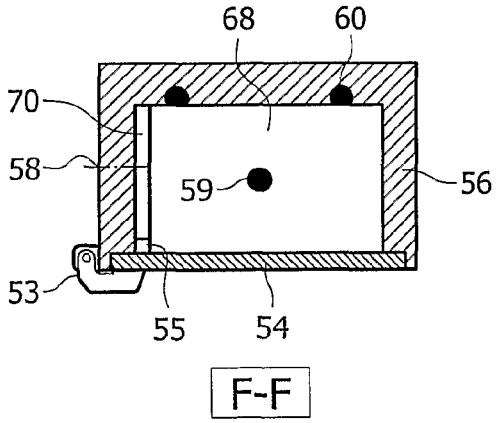
FIG. 7*b* shows a cross-section of the device in a closed position along line F-F as indicated in FIG. 7*a*.
Figure 7C:
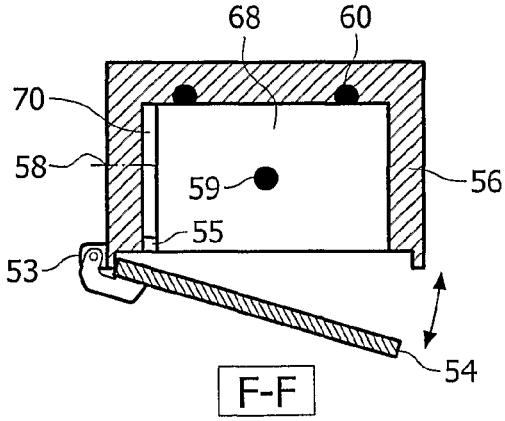
FIG. 7*c* shows a cross-section of the device in an opened position along line F-F as indicated in FIG. 7*a*.

FIG. 7*b* shows a cross-section of device 51 in a closed position along line F-F as indicated in FIG. 7*a*. Device 51 shown in FIGS. 7*a*-7*c* is structurally almost identical to the device 7 shown in FIGS. 2*a*-2*c*, wherein base structure 56 is provided with an assembly of a plurality of guide elements 68, 70 mutually coupled by a connecting element 59, wherein the assembly supports on elastic elements 60 arranged in base structure 56. The difference with the embodiment shown in FIGS. 2*a*-2*c* is that heating element 54 is connected hingedly on one side to base structure 56 by means of hinge 53. In the shown situation heating element 54 closes flow route 55, whereby formation of steam in flow route 55 can be prevented or at least be countered, and wherein liquid will be heated only to a desired temperature. FIG. 7*c* shows a cross-section of the device in an opened position along line F-F as indicated in FIG. 7*a*. In this opened situation steam will form between base structure 56, or at least the guide elements 68, 70, and heating element 54, which steam can then be usefully employed, for instance to prepare drinks, clean surfaces and so on.

Figure 8A:
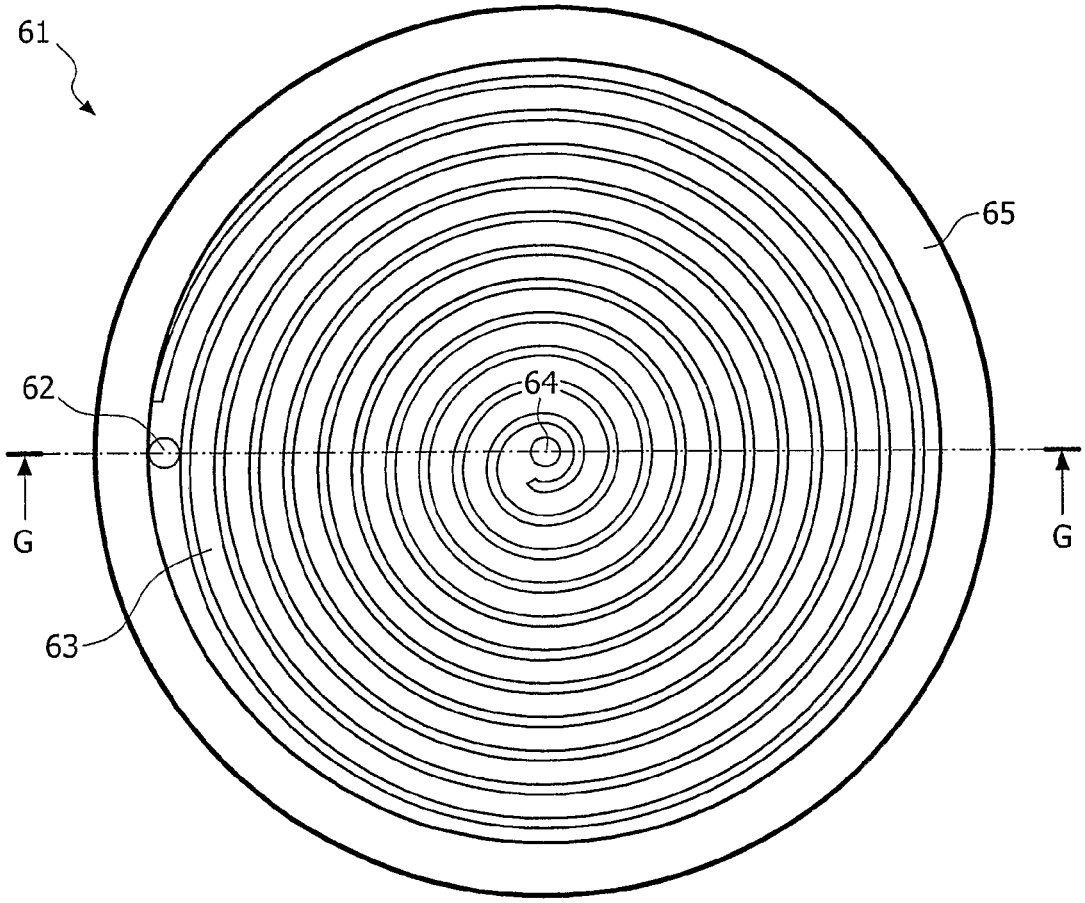
FIG. 8*a* shows a cross-section of an eighth embodiment of the device according to the invention.
Figure 8B:
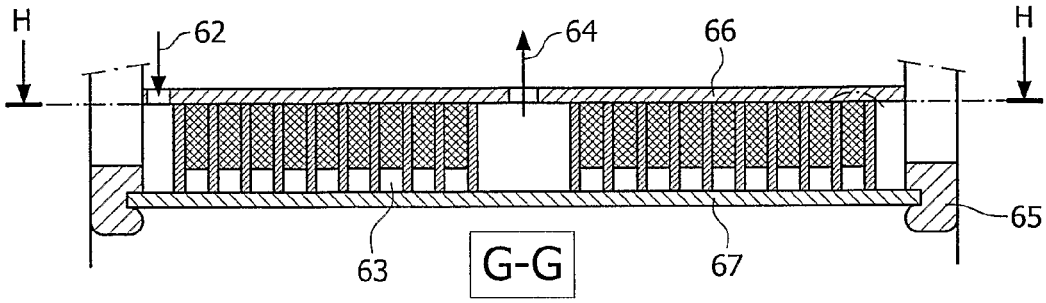
FIG. 8*b* shows a cross-section of the device in a closed position along line G-G as indicated in FIG. 8*a*.
Figure 8C:
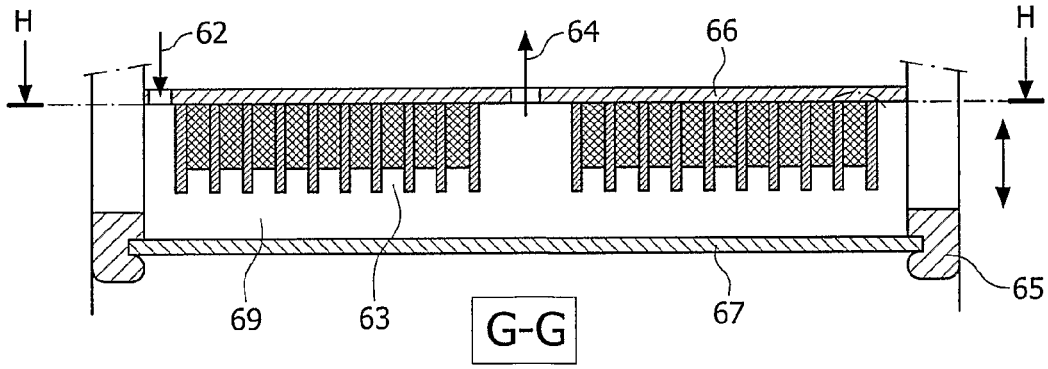
FIG. 8*c* shows a cross-section of the device in an opened position along line G-G as indicated in FIG. 8*a*.

FIG. 8*a* shows a cross-section of an eighth embodiment of device 61 according to the invention. Device 61 is structurally similar to the embodiment of the device 18 shown in FIGS. 3*a*-3*c*. Device 61 comprises a spiral-shaped channel 63 provided with a feed 62 and a discharge 64. Channel 63 can be pushed against a plate-like heating element 67 by means of a pressing element 66 connected to channel 63 in order to enable relatively efficient heating of liquid fed to channel 63. Heating element 67 is herein held in stationary position by an annular seal 65. Pressing element 66, and therewith also channel 63 can, as stated above, be pressed against heating element 67 in a first (closed) position (see FIG. 8*b*), but can be displaced in a direction away from heating element 67 in an (opened) second position, whereby formation of steam can be realized in a steam chamber 69 formed between channel 63 and heating element 67 (see FIG. 8*c*). The formed steam can further be removed from device 61 via discharge 64. It is thus possible to heat liquid or generate steam, or at least vapour, in relatively effective and efficient manner by means of changing the relative orientation of the (single) heating element 67 and channel 63.

It will be apparent that the invention is not limited to the exemplary embodiments shown and described here, but that numerous variants, which will be self-evident to the skilled person in this field, are possible within the scope of the appended claims.

The invention claimed is:

1. A device for heating liquids, comprising:

a base structure, and at least one heating element connecting to the base structure, wherein at least one non-linear channel structure is arranged between the base structure and the heating element for throughflow of a liquid for heating, wherein the channel structure has an at least partly spiral-shaped form and is formed at least partially by at least one spirally wound strip having a flexibility such that mutually adjoining strip parts of the strip can slide relative to each other.

2. The device as claimed in claim 1, wherein the heating element takes a substantially plate-like form.

3. The device as claimed in claim 1, wherein the channel length of the channel structure lies between 0.3 and 7 meters, in particular between 0.5 and 5 meters.

4. The device as claimed in claim 1, wherein the cross-section of the channel structure has a surface area which lies between 1 and 100 $mm^2$, in particular between 2 and 50 $mm^2$.

5. The device as claimed in claim 1, wherein the device is provided with a pump for pumping the liquid for heating under pressure through the channel structure.

6. The device as claimed in claim 5, wherein a pump flow rate of the pump can be regulated.

7. The device as claimed in claim 6, wherein the device is provided with sensor means coupled to the pump for regulating the pump flow rate subject to the liquid temperature in the channel structure.

8. The device as claimed in claim 1, wherein the heating element is displaceable relative to the base structure between a position connecting to the channel structure and a position situated at a distance from the channel structure.

9. The device as claimed in claim 1, wherein the device comprises bias-generating means to enable the base structure to connect under bias to the heating element.

10. The device as claimed in claim 1, wherein the spirally wound strip is formed of metal.

11. The device as claimed in claim 10, wherein said metal is steel.

12. A device for heating liquids, comprising:

a base structure, and at least one heating element connecting to the base structure, wherein at least one non-linear channel structure is arranged between the base structure and the heating element for throughflow of a liquid for heating, wherein the device comprises bias-generating means to enable the base structure to connect under bias to the heating element, wherein the heating element is displaceable relative to the base structure between a position connecting to the channel structure and a position situated at a distance from the channel structure, and wherein the base structure and the heating element in the position at a distance from the base structure mutually enclose an evaporation chamber.

13. A device for heating liquids, comprising:

a base structure, and at least one heating element connecting to the base structure, wherein at least one non-linear channel structure is arranged between the base structure and the heating element for throughflow of a liquid for heating, wherein the device comprises bias-generating means to enable the base structure to connect under bias to the heating element, wherein the device is provided with a pump for pumping the liquid for heating under pressure through the channel structure, and wherein the pump is coupled to the heating element and/or the base structure in order to change the relative orientation of the heating element and the base structure.

* * * * *